US007362078B2

(12) United States Patent
Agari

(10) Patent No.: US 7,362,078 B2
(45) Date of Patent: Apr. 22, 2008

(54) POWER SUPPLY CIRCUIT

(75) Inventor: Hideki Agari, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 171 days.

(21) Appl. No.: 11/294,457

(22) Filed: Dec. 6, 2005

(65) Prior Publication Data

US 2006/0132998 A1 Jun. 22, 2006

(30) Foreign Application Priority Data

Dec. 7, 2004 (JP) ..... 2004-354357

(51) Int. Cl.
*G05F 1/56* (2006.01)

(52) U.S. Cl. ..... 323/268; 323/272

(58) Field of Classification Search ..... 323/282–290, 323/249, 266, 277, 280, 268–273; 363/49–50
See application file for complete search history.

(56) References Cited

U.S. PATENT DOCUMENTS 5,191,278 A * 3/1993 Carpenter ..... 323/275
6,812,682 B2 * 11/2004 Hachiya ..... 323/284
7,049,879 B2 * 5/2006 Osamura et al. ..... 327/419

FOREIGN PATENT DOCUMENTS

JP 2734551 9/1998

* cited by examiner

*Primary Examiner*—Rajnikant B. Patel
(74) *Attorney, Agent, or Firm*—Dickstein Shapiro LLP

(57) ABSTRACT

The present invention relates to a power supply circuit that can intermittently operate when its load is small and therefore can reduce current consumption at a sleep mode. The power supply circuit for receiving an input voltage at an input terminal, converting the input voltage to an output voltage and outputting the output voltage to a load connected to an output terminal comprises: a power supply circuit unit; an output current detecting circuit unit; and an output voltage detecting circuit unit; whereby the output supply voltage detecting circuit unit makes the power supply circuit unit operate when the detected voltage becomes equal to or lower than a predetermined value, and thereby the power supply circuit unit performs intermittent operations.

14 Claims, 5 Drawing Sheets

POWER SUPPLY CIRCUIT

BACKGROUND OF THE INVENTION

1. Field of the Invention

The present invention generally relates to a power supply circuit utilized as constant power supply, and specifically relates to such power supply circuits that switch between an active mode and a sleep mode.

2. Description of the Related Art

In this technology area, there are some types of power supply circuits. In one type, consumption current is large for improving PSRR (ripple removing rate) and load transient response. In another type not-requiring high speed response, consumption current is lowered.

For example, a power supply circuit as shown in FIG. 5 has a voltage regulator as a series regulator. The power supply circuit has a circuit having a large current consumption for improving PSRR or load transient response. Sometimes, this power supply circuit is used for cellular phones having an active mode (operating mode) and a sleep mode (waiting mode). In such situation, while the cellular phone is in the sleep mode that does not require high speed response, the power supply circuit consumes the current wastefully.

One technology dealing with this issue is disclosed in Japanese Patent No. 2,734,551, in which a high speed amplifier having large current consumption and a slow speed amplifier having low current consumption are switched.

This technology, however, needs to have both the high speed amplifier and the low speed amplifier, making its chip area larger and increases cost.

SUMMARY OF THE INVENTION

Accordingly, it is a general object of the present invention to provide a power supply circuit that can intermittently operate when its load is small and therefore can reduce current consumption at a sleep mode without increasing manufacturing cost.

Features and advantages of the present invention are set forth in the description that follows, and in part will become apparent from the description and the accompanying drawings, or may be learned by practice of the invention according to the teachings provided in the description. Objects as well as other features and advantages of the present invention will be realized and attained by a charging system particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides as follows.

According to one feature of the present invention, there is provided a power supply circuit for receiving an input voltage at an input terminal, converting the input voltage to an output voltage and outputting the output voltage to a load connected to an output terminal, comprising:

a power supply circuit unit for converting the input voltage to a predetermined constant voltage and outputting the converted voltage to the output terminal, the power supply circuit unit operating in accordance with a first control signal;

an output current detecting circuit unit for detecting a current output from the power supply circuit unit, and outputting a second control signal when the detected current is smaller than a predetermined value i1; and an output voltage detecting circuit unit for detecting a voltage output from the power supply circuit unit, and operating while the output current detecting circuit unit outputs the second control signal, the output voltage detecting circuit unit stopping operation of the power supply circuit unit with the first control signal when the detected voltage exceeds a predetermined value Vdet1;

whereby the output supply voltage detecting circuit unit causes the power supply circuit unit to operate when the detected voltage becomes equal to or lower than a predetermined value Vdet2 that is lower than the predetermined value Vdet1, thereby the power supply circuit unit performs intermittent operations.

BRIEF DESCRIPTION OF THE DRAWINGS

Other objects, features, and advantages of the present invention will become apparent from the following detailed description when read in conjunction with the accompanying drawings, in which.

DESCRIPTION OF THE PREFERRED EMBODIMENTS

Figure 1:
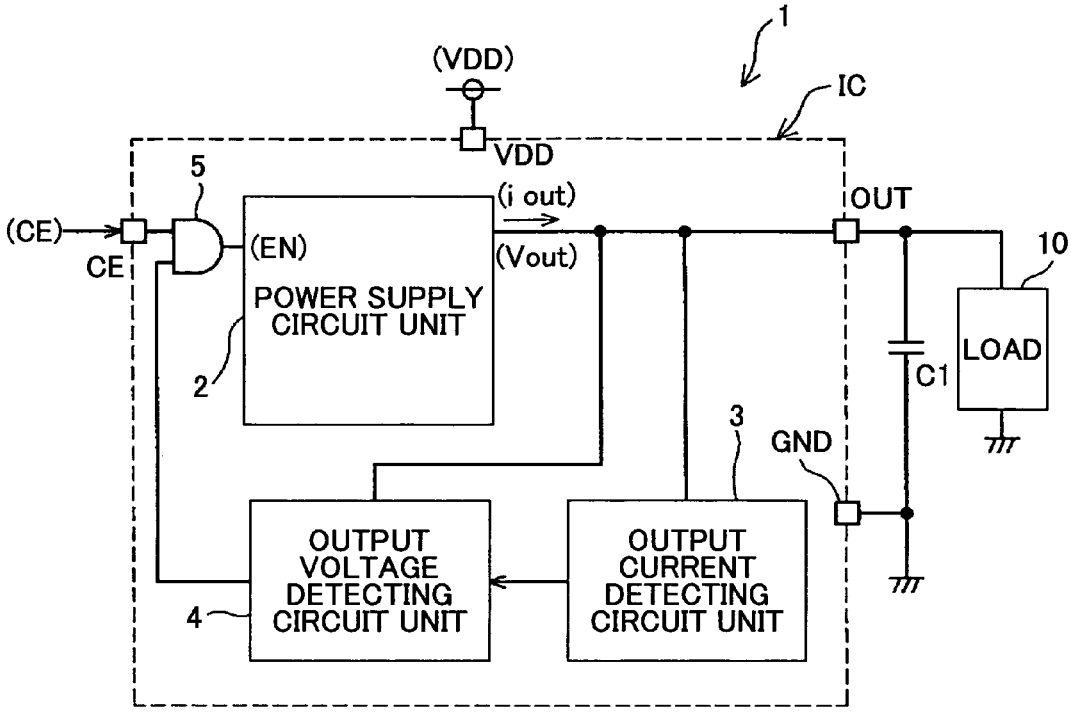
FIG. 1 is a block diagram of a power supply circuit according to an embodiment of the present invention.

In the following, embodiments of the present invention are described with reference to the accompanying drawings. In the drawings, the same or similar parts are assigned the same or similar reference numerals.

FIG. 1 shows a block diagram of a power supply circuit according to an embodiment of the present invention.

The power supply circuit 1 shown in FIG. 1 comprises a power supply circuit unit 2, an output current detecting circuit unit 3, an output voltage detecting circuit unit 4, an AND circuit 5 and a capacitor C1. The power supply circuit unit 2, the output current detecting circuit unit 3, the output voltage detecting circuit unit 4, and the AND circuit 5 may be integrated into one IC chip as shown in FIG. 1. The power supply circuit unit 2 receives a supply voltage VDD and generates and outputs a predetermined voltage Vdet1 to a terminal OUT of the IC chip. The output current detecting circuit unit 3 detects an output current iout, and determines based on the detected current whether a load 10 to be power supplied by the power supply circuit unit 2 is a small load having a small consumption current. The output current detecting circuit unit 3 generates a signal indicating the determination result and outputs the signal to the output voltage detecting circuit unit 4.

The output voltage detecting circuit unit 4 monitors an output voltage Vout from the power supply circuit unit 2, and outputs a low level signal when the output voltage Vout is lower than a predetermined value. The signal output from the output current detecting circuit 3 and indicating the determination result is an example of the second control signal, and the signal output from the output voltage detecting circuit unit 4 is an example of the first control signal. The IC has a VDD terminal for receiving the power supply voltage VDD, a GND terminal connected to ground potential, and a CE terminal receiving a chip enabling signal from the outside. The OUT terminal of the IC is for outputting the output power supply voltage Vout to the outside. Between the OUT terminal and the GND terminal, a capacitor C1 is connected externally.

The output voltage detecting circuit unit 4 operates when the result of determination output from the output current detecting circuit unit 3 indicates that the output current iout from the power supply circuit unit 2 is lower than a predetermined value il, therefore indicating that the load connected to the terminal OUT is small. The output voltage detecting circuit unit 4 outputs a binary signal to one input of the AND circuit 5. In this case, the output voltage detecting circuit unit 4 outputs a low level signal when the output voltage Vout is equal to or higher than the predetermined value Vdet1. The output voltage detecting circuit unit 4 outputs a high level signal when the output voltage Vout is equal to or lower than a predetermined value Vdet2.

On the other hand, the output voltage detecting circuit unit 4 stops its operation and outputs a high level signal to the one input of the AND circuit 5 when the result of determination output from the output current detecting circuit unit 3 indicates that the output current iout from the power supply circuit unit 2 exceeds the predetermined value i1, therefore indicating that the load 10 connected to the OUT terminal is not a small load.

The other input of the AND circuit is connected to the CE terminal of the IC, into which a chip enable signal CE is input from the outside. When the chip enable signal CE becomes high, the AND circuit 5 outputs the signal from the output voltage detecting circuit unit 4 to the power supply circuit unit 2. When the chip enable signal CE becomes low, the AND circuit 5 outputs a low level signal to the power supply circuit unit 2, irrespective of the signal from the output voltage detecting circuit unit 4.

The power supply circuit unit 2 starts operation when its EN terminal receives a high level signal from the AND circuit 5. The power supply circuit unit 2 stops operation when the EN terminal receives a low level signal from the AND circuit 5. The output terminal of the power supply circuit unit 2 is connected to the OUT terminal of the IC and supplies an output voltage to the OUT terminal.

Figure 2:
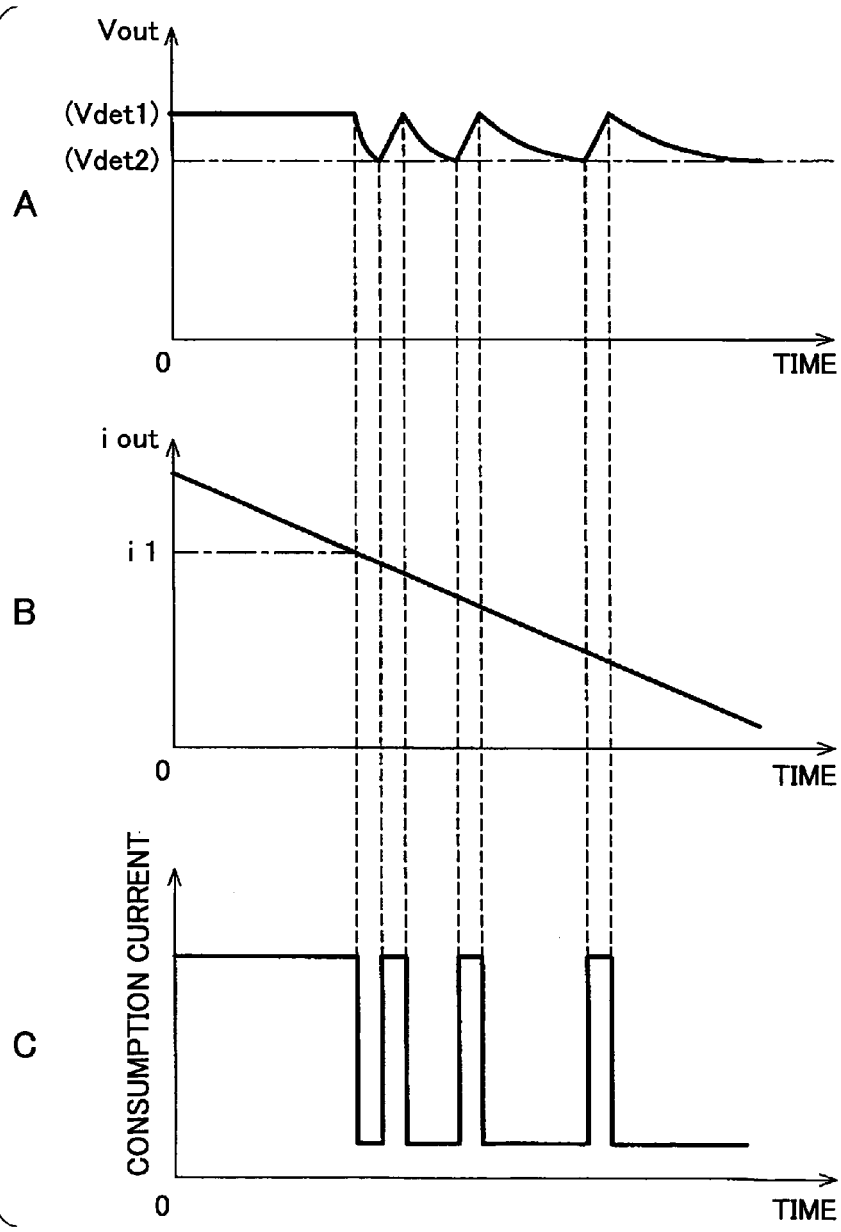
FIGS. 2A-C are graphs illustrating operations of the power supply circuit shown in FIG. 1.

FIGS. 2A-2C are graphs illustrating operation of the power supply circuit unit 1. The operation of the power supply circuit unit 1 is explained in more detail with reference to FIGS. 2A-2C. FIGS. 2A-2C show the operation of the power supply circuit unit 1 when the CE terminal of the IC is receiving the high level chip enable signal CE.

FIG. 2A shows output voltage Vout, FIG. 2B shows output current iout, and FIG. 2C shows consumption current inside of the power supply circuit unit 2.

When the output current iout exceeds the predetermined value i1 (FIG. 2B), that is when a load 10 connected to the OUT terminal is not a small load, the output voltage detecting circuit unit 4 stops its operation and outputs a high level signal at its output terminal, making the EN terminal of the power supply circuit unit 2 high. In this case, the power supply circuit unit 2 generates the predetermined constant voltage Vdet1 based on the power supply voltage VDD and outputs it at the OUT terminal of the IC (FIG. 2A).

Next, when the output current iout becomes lower than the predetermined value i1 (FIG. 2B), that is when the load connected to the OUT terminal equates to a light load condition, the output current detecting circuit unit 3 causes the output voltage detecting circuit unit 4 to operate. While the output voltage Vout is lower than the predetermined value Vdet1 (FIG. 2A), the output voltage detecting circuit unit 4 outputs a low level signal and stops the operation of the power supply circuit unit 2 (FIG. 2C). On the other hand, while the output voltage Vout becomes equal to or lower than the predetermined voltage Vdet2 (FIG. 2A), the output voltage detecting circuit unit 4 outputs a high level signal and causes the power supply circuit unit 2 to operate.

By repeating these operations, the power supply circuit unit 2 performs intermittent operations (FIG. 2C). When the EN terminal is receiving a high level signal and the power supply circuit unit 2 is operating, the consumption current of the power supply circuit unit 2 is several tens to several hundreds μA. When the EN terminal is receiving a low level signal and the power supply circuit unit 2 does not operate, the consumption current of the power supply circuit unit 2 is merely several μA. In this manner, low power consumption can be attained by a simple and low cost circuit structure according to this embodiment of the present invention.

Figure 3:
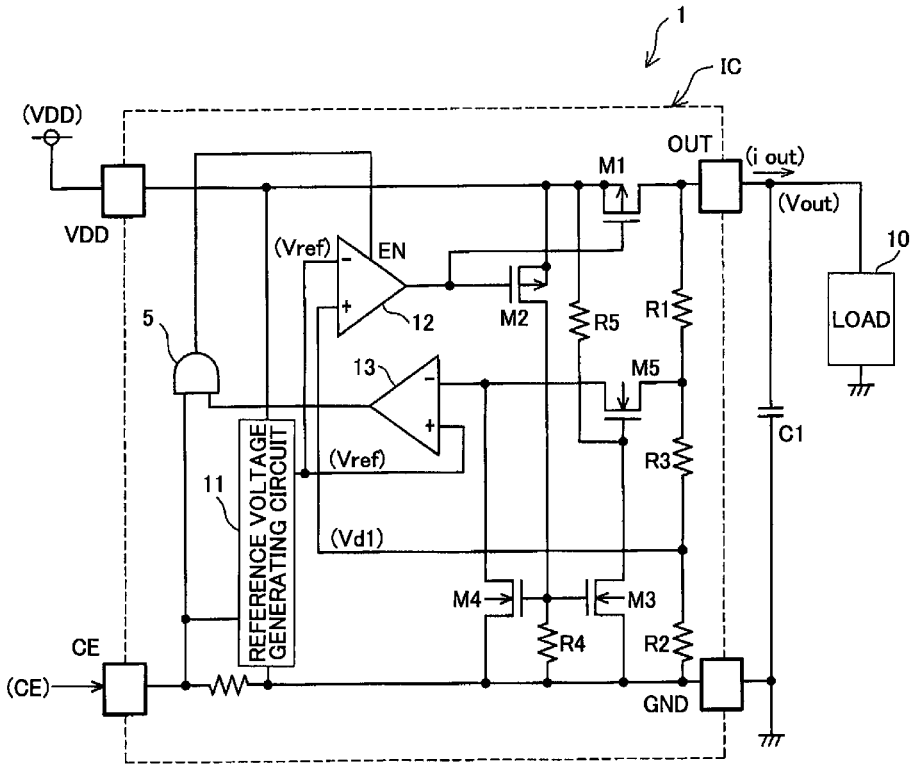
FIG. 3 is one example circuit diagram of the power supply circuit shown in FIG. 1.

FIG. 3 shows a block diagram of an example circuit of the power supply circuit 1 shown in FIG. 1. In this example shown in FIG. 3, the power supply circuit unit 2 employs a linear regulator as a voltage regulator. As shown in FIG. 3, the power supply circuit unit 2 functions as a series regulator, converts a power supply voltage VDD into a predetermined voltage Vdet1, and generates and outputs an output voltage Vout at the OUT terminal.

The power supply circuit unit 2 comprises a reference voltage generating circuit 11 for generating and outputting a predetermined reference voltage Vref, resistors R1~R3, an output voltage controlling transistor M1, and an error amplifier 12. The resistors R1~R3 are for detecting the output voltage. The resistors R1~R3 divide the output voltage Vout, and generate and output a partial voltage Vd1. The output voltage controlling transistor M1 may be a PMOS transistor and controls the output voltage Vout by controlling a current flowing to the OUT terminal in response to a signal input to its gate. The error amplifier 12 controls the operation of the output voltage controlling transistor M1 so that the partial voltage Vd1 becomes the reference voltage Vref.

The reference voltage generating circuit 11 is an example of a reference voltage generating circuit unit, the combination of the resistors R1~R3 is an example of a first output voltage detecting circuit unit, the error amplifier 12 is an example of an error amplifying circuit unit, and the partial voltage Vd1 is an example of a first proportional voltage.

The output voltage controlling transistor M1 is connected between the VDD terminal and the OUT terminal. A gate of the output voltage controlling transistor M1 is connected to an output terminal of the error amplifier 12. The resistors R1, R3 and R2 are connected in series between the OUT terminal and the GND terminal of the IC. A partial voltage Vd1 taken from a node between the resistors R3 and R2 is input to a non-inverting input of the error amplifier 12. The reference voltage generating circuit 11 is connected between the VDD terminal and the GND terminal. A reference voltage Vref from the reference voltage generating circuit 11 is input to an inverting input of the error amplifier 12. An EN terminal of the error amplifier 12 is connected to an output of the AND circuit 5.

The output current detecting circuit unit 3 is formed by a PMOS transistor M2, NMOS transistors M3 and M4, and resistors R4 and R5. The output voltage detecting circuit unit 4 is formed by a comparator 13, an NMOS transistor M5, and resistors R1 through R3. The resistors R1 through R3 are shared by the power supply circuit unit 2 and the output voltage detecting circuit unit 4. The PMOS transistor M2 is an example of a first transistor. The NMOS transistors M3 and M4 and the resistors R4 and R5 form a control circuit unit. The comparator 13 is an example of a voltage comparing circuit unit. The NMOS transistor M5 is an example of a switching circuit unit. The combination of the resistors R1 through R3 is an example of a second output voltage detecting circuit unit.

Between the VDD terminal and the GND terminal, a series circuit of the PMOS transistor M2 and the resistor R4 and a series circuit of the resistor R5 and the NMOS transistor M3 are connected in parallel. A gate of the PMOS transistor M2 is connected to the output of the error amplifier 12. The NMOS transistor M4 is connected between the inverting input terminal of the comparator 13 and the GND terminal. Gates of the NMOS transistors M3 and M4 are connected to each other and the resistor R4 is connected between the connecting node and the GND terminal.

The NMOS transistor M5 is connected between the inverting input terminal of the comparator 13 and the connecting node of the resistors R1 and R3. A gate of the NMOS transistor M5 is connected to the connecting node between the resistor R5 and the NMOS transistor M3. The predetermined reference voltage Vref is input to the non-inverting input terminal of the comparator 13. The output terminal of the comparator 13 is connected to a corresponding input terminal of the AND circuit 5. The chip enable signal CE received at the CE terminal is input to the reference voltage generating circuit 11. When the chip enable signal CE becomes low, the reference voltage generating circuit 11 generates and outputs the predetermined reference voltage Vref. When the chip enable signal CE becomes high, the reference voltage generating circuit 11 stops operation and the output thereof becomes 0 voltage. Between the CE terminal and the GND terminal, a resistor is connected. A voltage at the connecting node between the resistor R1 and the resistor R3 is an example of a second proportional voltage.

In this structure of the power supply circuit unit 2, the error amplifier 12 starts operation when the EN terminal receives a high level signal. The power supply circuit unit 2 controls the output voltage controlling transistor M1 so that the partial voltage Vd1 becomes equal to the predetermined reference voltage Vref. In this manner, the current output from the output voltage controlling transistor M1 is controlled. When the EN terminal receives a low level signal, the error amplifier 12 stops operation and the output voltage controlling transistor M1 turns off to a cut-off state.

In the output current detecting circuit unit 3, while the error amplifier 12 operates, the PMOS transistor M2 outputs a current to the resistor R4, which current is proportional to the current output from the output voltage controlling transistor M1. The gates of the NMOS transistors M3 and M4 receive voltages in accordance with the current output from the PMOS transistor M2.

For example, it is assumed that the resistor R1 has a resistance of 0.9 MΩ, the resistor R2 has a resistance of 1 MΩ and the resistance R3 has a resistance of 0.01 MΩ. When the reference voltage Vref is 1 V, the output voltage Vout becomes 2 V; therefore the predetermined voltage Vdet1 shown in FIG. 2 becomes 2 V. When the NMOS transistor M5 turns on, the inverting input terminal of the comparator 13 receives a voltage of 1.01 V. If the size of the PMOS transistor M2 is 1/1000 of the size of the output voltage controlling transistor M1, when the output current iout is 1 mA, the PMOS transistor M2 outputs a current of 1 μA. If the resistor R4 has a resistance of 1 MΩ, a voltage across the resistor R4 becomes 1 V. If each threshold voltage of the NMOS transistors M3 and M4 is 1 V, the predetermined value i1 becomes 1 mA.

When the output current iout exceeds the predetermined value i1 indicating not-low load, the PMOS transistor M2 increases its output current. The gate voltages of the NMOS transistors M3 and M4 become higher than a threshold voltage Vth, and the NMOS transistors M3 and M4 turn on to a conducting state. It is assumed that the resistor R5 has a large resistance of several MΩ. When the NMOS transistor M3 turns on, the NMOS transistor M5 turns off to a cut-off state. Then the inverting input terminal of the comparator 13 is connected to the GND terminal via the conducting NMOS transistor M4. The output terminal of the comparator 13 becomes high, and the power supply circuit unit 2 operates normally.

When the output current iout becomes lower than the predetermined value i1 indicating a low load state, the PMOS transistor M2 decreases its current. The gate voltages of the NMOS transistors M3 and M4 become lower than the threshold voltage Vth, and the NMOS transistors M3 and M4 turn off to a cut-off state. Therefore, the NMOS transistor M5 turns on to a conducting state, and the inverting input terminal of the comparator 13 receives 1.01 V. Because the reference voltage Vref is 1 V, the comparator 13 outputs a low level signal. The output terminal of the AND circuit 5 becomes low, and the error amplifier 12 and therefore the power supply circuit unit 2 stop operation. The output voltage Vout shown in FIG. 2A becomes low.

When the output voltage Vout becomes lower to a voltage of Vdet2, for example 1.98 V, the comparator 13 outputs a high level signal. The output terminal of the AND circuit 5 becomes high and the error amplifier 12 and therefore the power supply circuit unit 2 start operations. The output voltage Vout goes up as shown in FIG. 2A. If the comparator 13 has hysteresis characteristics of 20 mV, when the output voltage Vout reaches 2 V, the above explained operation is repeated and therefore the power supply circuit unit 2 performs intermittent operations.

With reference to FIG. 2A, if the capacitor C1 has a capacitance of 1 μF, it takes about 10 μsec for the output voltage Vout to change from 2 V to 1.98 V when the output current iout is 1 mA. If the comparator 13 has a delay time for outputting a high level signal, the power supply circuit unit 2 can continue to operate during the delay time, and therefore can perform the intermittent operations without the hysteresis. The voltage value Vdet2 shown in FIG. 2*a* can be adjusted by changing the resistance of the resistor R3.

Figure 4:
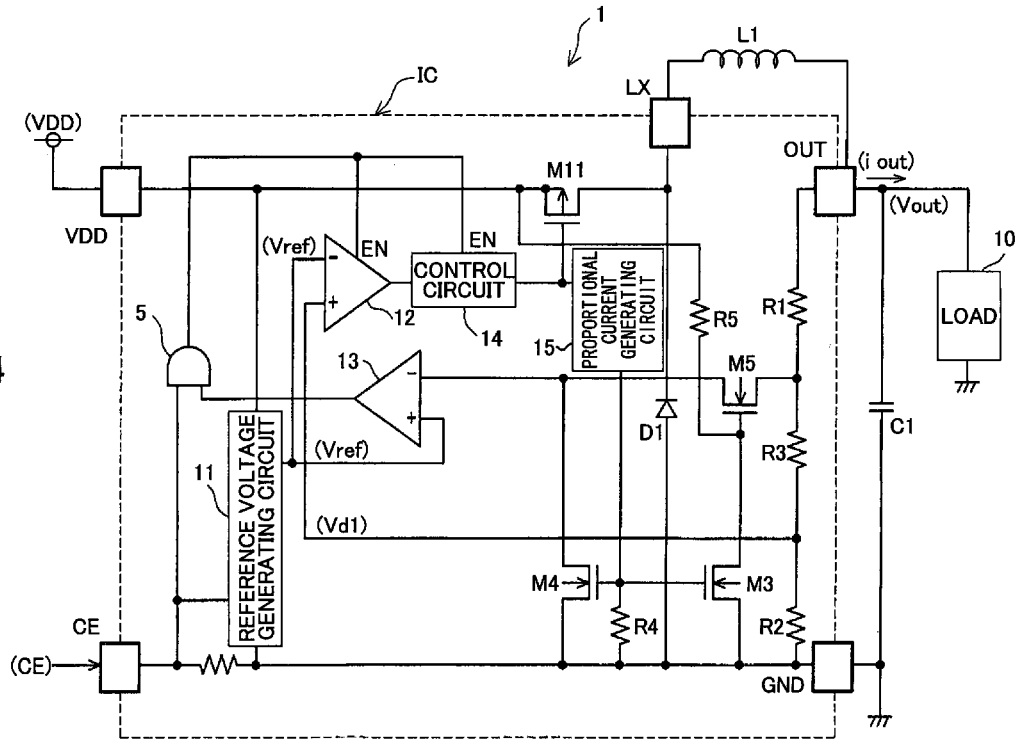
FIG. 4 is another example circuit diagram of the power supply circuit shown in FIG. 1.
Figure 5:
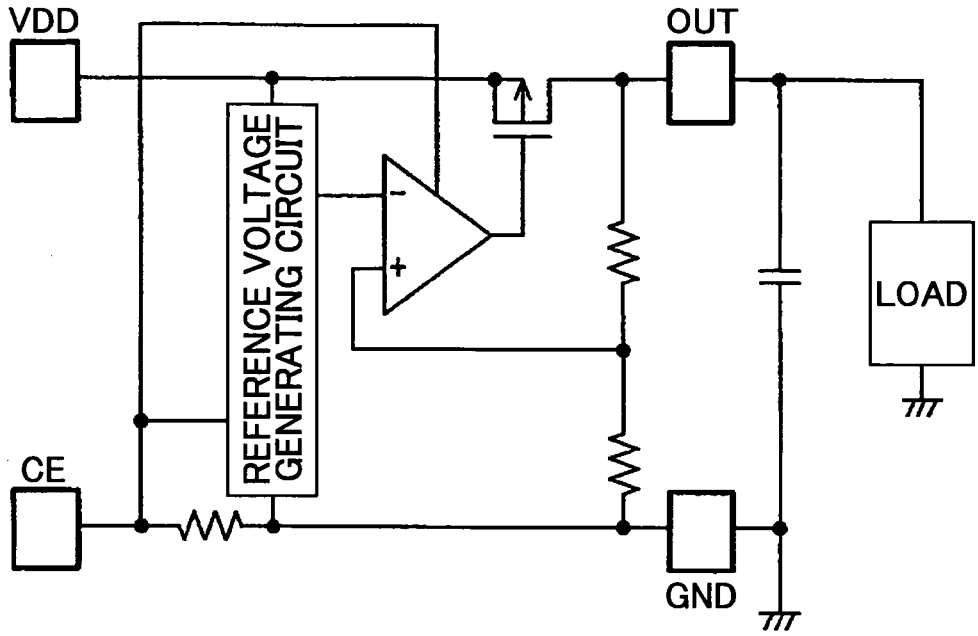
FIG. 5 is a block diagram of a related art power supply circuit.

FIG. 4 is a circuit diagram of another example of the power supply circuit 1 shown in FIG. 1. In this example, the power supply circuit unit 2 has a switching regulator for functioning as a DC/DC converter. In FIG. 4, parts that are the same as or similar to parts shown in FIG. 3 are assigned the same or similar reference numerals, and their explanation is omitted here.

An IC shown in FIG. 4 has a VDD terminal, a GND terminal, a CE terminal, an OUT terminal and an LX terminal. As shown in FIG. 4, the power supply circuit unit 2 comprises a step-down switching regulator, which receives a power supply voltage VDD at the VDD terminal, converts it to a predetermined voltage Vdet1 and generates and outputs an output voltage Vout to the OUT terminal.

The power supply circuit unit 2 comprises a switching transistor M11, a flywheel diode D1, a smoothing inductor L1 and capacitor C1, resistors R1 through R3, a reference voltage generating circuit 11, an error amplifier 12, and a controlling circuit 14. The switching transistor M11 is a PMOS transistor for controlling the output of the power supply voltage received at the VDD terminal. The controlling circuit 14 generates a triangular signal having a predetermined frequency, and performs switching control on the switching transistor M11 based on the triangular signal and an output voltage of the error amplifier 12. A combination of the flywheel diode D1, the inductor L1 and the capacitor C1 is an example of a smoothing circuit. A combination of the error amplifier 12 and the controlling circuit 14 is an example of a switching controlling circuit unit. The controlling circuit 14 has an EN terminal, similar to the error amplifier 12. These EN terminals of the error amplifier 12 and the controlling circuit 14 are connected to each other and their node forms an EN terminal of the power supply circuit unit 2 and is connected to an output terminal of the AND circuit 5.

In this example shown in FIG. 4, the output current detecting circuit unit 3 is formed by a proportional current generating circuit 15, NMOS transistors M3, M4, and resistors R4, R5. The proportional current generating circuit 15 receives a signal output from the controlling circuit 14, and generates and outputs a current proportional to an output current iout from the power supply circuit unit 2. The output voltage detecting circuit unit 4 is formed by a comparator 13, an NMOS transistor M5, and resistances R1 through R3, similar to FIG. 3.

The proportional current generating circuit 15 is an example of a proportional current generating circuit unit, and a combination of the NMOS transistors M3, M4 and the resistors R4, R5 is an example of a controlling circuit unit.

The switching transistor M11 is connected between the VDD terminal and the LX terminal. The inductor L1 is connected between the LX terminal and the OUT terminal. The LX terminal is connected to a cathode of the diode D1 and the GND terminal is connected to an anode of the diode D1.

The proportional current generating circuit 15 receives a pulse signal which is output from the controlling circuit 14 to the switching transistor M11. This pulse signal is an example of the third controlling signal. In a case where the pulse signal is a signal for PWM controlling the switching transistor M11, the proportional current generating circuit 15 generates and outputs a current proportional to the duty cycle of the pulse signal. In a case where the pulse signal is a signal for PFM controlling the switching transistor M11, the proportional current generating circuit 15 generates and outputs a current proportional to frequency of the pulse signal.

In this structure of the power supply circuit unit 2, the error amplifier 12 and the controlling circuit 14 start operation when their EN terminals receive a high level signal. The error amplifier 12 compares the partial voltage Vd1 and the reference voltage Vref, and generates and outputs a voltage to the controlling circuit 14, in accordance with a comparison result. Based on the output voltage from the error amplifier 12 and the generated triangular signal, the controlling circuit 14 generates a pulse signal for switching controlling the switching transistor M11. The controlling circuit 14 drives the switching transistor M11 by using the pulse signal. When their EN terminals receive a low level signal, the error amplifier 12 and the controlling circuit 14 stop their operation and the switching transistor M11 turns off to a cut-off status.

In the output current detecting circuit unit 3, based on the output current iout from the power supply circuit unit 2, the proportional current generating circuit 15 generates and outputs a current proportional to the output current iout from the power supply circuit unit 2. Gates of the NMOS transistors M3 and M4 receive a voltage due to the resistor R4, in accordance with the current output from the proportional current generating circuit 15. Other operations of the output current detecting circuit unit 3 and the output voltage detecting circuit unit 4 are basically the same as FIG. 3 and therefore their explanation is omitted.

As explained above, in the power supply circuit according to the embodiment of the present invention, when the output iout becomes lower than the predetermined value i1, that is, the load connected to the OUT terminal equates to a light load condition, the output current detecting circuit unit 3 causes the output voltage detecting circuit unit 4 to start its operation. While the output voltage Vout is higher than the predetermined value Vdet2 which is lower than the predetermined value Vdet1, the output voltage detecting circuit unit 4 outputs a low level signal to stop the operation of the power supply circuit unit 2. When the output voltage Vout becomes lower than the predetermined value Vdet2, the output voltage detecting circuit unit 4 outputs a high level signal to cause the power supply circuit unit 2 to operate. By repeating such operations, the power supply circuit 2 can perform intermittent operations. In this manner, the power supply circuit according to the embodiment of the present invention can reduce current consumption during a sleep mode that does not require high speed response, without increasing cost.

The present invention is not limited to these embodiments, but variations and modifications may be made without departing from the scope of the present invention.

The present application is based on Japanese Priority Application No. 2004-354357 filed on Dec. 7, 2004 with the Japanese Patent Office, the entire contents of which are hereby incorporated by reference.

What is claimed is:

1. A power supply circuit for receiving an input voltage at an input terminal, converting the input voltage to an output voltage and outputting the output voltage to a load connected to an output terminal, comprising:

a power supply circuit unit for converting the input voltage to a predetermined constant voltage and outputting the converted voltage to the output terminal, the power supply circuit unit operating in accordance with a first control signal;

an output current detecting circuit unit for detecting a current output from the power supply circuit unit, and outputting a second control signal when the detected current is smaller than a predetermined value i1; and an output voltage detecting circuit unit for detecting a voltage output from the power supply circuit unit, and operating while the output current detecting circuit unit outputs the second control signal, the output voltage detecting circuit unit stopping operation of the power supply circuit unit with the first control signal when the detected voltage exceeds a predetermined value Vdet1;

whereby the output supply voltage detecting circuit unit causes the power supply circuit unit to operate when the detected voltage becomes equal to or lower than a predetermined value Vdet2 that is lower than the predetermined value Vdet1, thereby the power supply circuit unit performs intermittent operations.

2. The power supply circuit unit as claimed in claim 1, wherein when the detected current exceeds the predetermined value i1, the output current detecting circuit unit stops outputting the second control signal and stops operation of the output voltage detecting circuit unit, to allow the power supply circuit unit to operate.

3. The power supply circuit unit as claimed in claim 2, wherein the power supply circuit unit comprises a voltage regulator.

4. The power supply circuit unit as claimed in claim 3, wherein the power supply circuit unit is formed by a linear regulator, the linear regulator comprising:

an output voltage controlling transistor having a control electrode, for outputting a current from the input terminal to the output terminal, in accordance with a third control signal received at the control electrode;

a reference voltage generating circuit unit for generating and outputting a predetermined reference voltage;

a first output voltage detecting circuit unit for detecting the voltage at the output terminal, and generating and outputting a first proportional voltage that is proportional to the detected voltage; and an error amplifying circuit unit for operating in accordance with the first control signal, and controlling the output voltage controlling transistor with the third control signal so that the first proportional voltage becomes equal to the reference voltage.

5. The power supply circuit unit as claimed in claim 4, wherein the output voltage detecting circuit unit comprises:

a second output voltage detecting circuit unit for detecting the voltage at the output terminal and generating and outputting a second proportional voltage that is proportional to the detected voltage;

a switching circuit unit for outputting the second proportional voltage from the second output voltage detecting unit, when receiving the second control signal from the output current detecting circuit unit; and a voltage comparing circuit unit for comparing the reference voltage and the voltage from the switching circuit unit, and generating and outputting the first control signal in accordance with a comparison result.

6. The power supply circuit unit as claimed in claim 5, wherein the output current detecting circuit unit comprises:

a first transistor having a control electrode, for receiving the third control signal at the control electrode, and outputting a current proportional to the current output from the output voltage controlling transistor; and a control circuit unit for generating and outputting the second control signal when the current output from the first transistor indicates that the current output from the power supply circuit unit is equal to or smaller than the predetermined value i1;

whereby when the current output from the first transistor indicates that the current output from the power supply circuit unit exceeds the predetermined value i1, the control circuit unit stops outputting the second proportional voltage from the switching circuit unit with the second control signal and outputs a predetermined voltage lower than the reference voltage to the voltage comparing circuit unit instead of the second proportional voltage.

7. The power supply circuit unit as claimed in claim 2, wherein the power supply circuit unit comprises a DC/DC converter.

8. The power supply circuit unit as claimed in claim 7, wherein the power supply circuit unit comprises a switching regulator, the switching regulator comprising:

a switching transistor having a control electrode, for switching in accordance with a third control signal received at the control electrode, and controlling outputting the voltage received at the input terminal;

a smoothing circuit unit for smoothing the voltage output from the switching transistor and outputting the smoothed voltage to the output terminal;

a reference voltage generating circuit unit for generating and outputting a predetermined reference voltage;

a first output voltage detecting circuit unit for detecting the voltage at the output terminal, and generating and outputting a first proportional voltage that is proportional to the detected voltage; and a switching control circuit unit for operating in accordance with the first control signal, and controlling the switching transistor with the third control signal so that the first proportional voltage becomes equal to the reference voltage.

9. The power supply circuit unit as claimed in claim 8, wherein the output voltage detecting circuit unit comprises:

a second output voltage detecting circuit unit for detecting the voltage at the output terminal and generating and outputting a second proportional voltage that is proportional to the detected voltage;

a switching circuit unit for outputting the second proportional voltage from the second output voltage detecting unit, when receiving the second control signal from the output current detecting circuit unit; and a voltage comparing circuit unit for comparing the reference voltage and the voltage from the switching circuit unit, and generating and outputting the first control signal in accordance with a comparison result.

10. The power supply circuit unit as claimed in claim 9, wherein the output current detecting circuit unit comprises:

a proportional current generating circuit unit for, based on the third control signal, generating and outputting a current proportional to the current output from the power supply circuit unit; and a control circuit unit for generating and outputting the second control signal when the current output from the proportional current generating circuit unit indicates that the current output from the power supply circuit unit is equal to or smaller than the predetermined value i1;

whereby when the current output from the proportional current generating circuit unit indicates that the current output from the power supply circuit unit exceeds the predetermined value i1, the control circuit unit stops outputting the second proportional voltage from the switching circuit unit with the second control signal and outputs a predetermined voltage lower than the reference voltage to the voltage comparing circuit unit instead of the second proportional voltage.

11. The power supply circuit unit as claimed in claim 10, wherein the third control signal is a pulse signal for PWM controlling; and the proportional current generating circuit unit generates and outputs a current proportional to the duty cycle of the pulse signal.

12. The power supply circuit unit as claimed in claim 10, wherein the third control signal is a pulse signal for PFM controlling; and the proportional current generating circuit unit generates and outputs a current proportional to the frequency of the pulse signal.

13. The power supply circuit unit as claimed in claim 1, wherein the power supply circuit unit, the output current detecting circuit unit and the output voltage detecting circuit unit are integrated into one IC.

14. The power supply circuit unit as claimed in claim 8, wherein the smoothing circuit unit comprises a smoothing inductor and capacitor, and a semiconductor device for emitting energy stored in the inductor; and the semiconductor device, the switching transistor, the reference voltage generating circuit unit, the first output voltage detecting circuit unit, the switching control circuit unit, the output current detecting circuit unit and the output voltage detecting circuit unit are integrated into one IC.

* * * * *